US012752152B2

(12) United States Patent
Liu et al.

(10) Patent No.: US 12,752,152 B2
(45) **Date of Patent: *Oct. 6, 2026**

(54) STATIONARY BIKE WITH VISUAL INDICATION OF SLOPE

(71) Applicant: Dyaco International Inc., Taipei City (TW)

(72) Inventors: Shih-Wei Liu, Taipei (TW); Shin-Lan Tseng, Taipei (TW)

(73) Assignee: Dyaco International Inc., Taipei City (TW)

( * ) Notice: Subject to any disclaimer, the term of this patent is extended or adjusted under 35 U.S.C. 154(b) by 147 days.

This patent is subject to a terminal disclaimer.

(21) Appl. No.: 18/829,963

(22) Filed: Sep. 10, 2024

(65) Prior Publication Data

US 2026/0048292 A1 Feb. 19, 2026

(30) Foreign Application Priority Data

Aug. 13, 2024 (TW) ..... 113130321

(51) Int. Cl.

| | |
|---|---|
| ***A63B 22/06*** | (2006.01) |
| ***A63B 21/00*** | (2006.01) |
| ***A63B 21/22*** | (2006.01) |
| ***A63B 22/00*** | (2006.01) |
| ***A63B 24/00*** | (2006.01) |
| ***A63B 71/06*** | (2006.01) |

(52) U.S. Cl.

CPC .... *A63B 22/0605* (2013.01); *A63B 21/00192* (2013.01); *A63B 21/151* (2013.01); *A63B 21/225* (2013.01); *A63B 22/0046* (2013.01); *A63B 24/0062* (2013.01); *A63B 71/0622* (2013.01); *A63B 2071/0694* (2013.01); *A63B 2220/30* (2013.01); *A63B 2225/093* (2013.01); *A63B 2230/06* (2013.01); *A63B 2230/75* (2013.01)

(58) Field of Classification Search

CPC ..... A63B 21/00192; A63B 21/151; A63B 21/225; A63B 22/0046; A63B 22/0605; A63B 24/0062; A63B 71/0622; A63B 2071/065; A63B 2071/0658; A63B 2071/0694; A63B 2220/30; A63B 2225/093; A63B 2230/06; A63B 2230/062; A63B 2230/75

See application file for complete search history.

(56) References Cited

U.S. PATENT DOCUMENTS

| | | | | |
|---|---|---|---|---|
| 2018/0117383 | A1* | 5/2018 | Workman ..... | A63B 22/0605 |
| 2018/0200566 | A1* | 7/2018 | Weston ..... | A63B 71/0622 |
| 2020/0338383 | A1* | 10/2020 | Liu ..... | A63B 21/225 |
| 2021/0077887 | A1* | 3/2021 | Moritz ..... | A63B 22/0235 |

* cited by examiner

*Primary Examiner* — Megan Anderson
*Assistant Examiner* — Jonathan A Dicuia
(74) *Attorney, Agent, or Firm* — Donald E. Stout; Stout, Uxa & Buyan, LLP

(57) ABSTRACT

A stationary bike includes a lifting mechanism, a frame, a resistance device, a reluctance mechanism, a linkage mechanism, a linear mechanism, and a first visual indicator. The linear mechanism is connected between the main frame and the lifting mechanism. The length of the linear mechanism can be adjusted to change the angle between the lifting mechanism and the ground. At the same time, the resistance applied by the reluctance mechanism to the resistance device is varied. The first visual-indicator emits a color light according to a first parameter comprising a slope of the stationary bike.

10 Claims, 4 Drawing Sheets

STATIONARY BIKE WITH VISUAL INDICATION OF SLOPE

CROSS-REFERENCE TO RELATED APPLICATIONS

The entire contents of Taiwan Patent Application No. 113130321, filed on Aug. 13, 2024, from which this application claims priority, are expressly incorporated herein by reference.

BACKGROUND OF THE INVENTION

1. Field of the Invention

The present invention relates to an indoor fitness machine, and particularly relates a stationary bike with a visual indication of slope.

2. Description of Related Art

Indoor exercise is great alternative to bad weather, and it provides a variety of benefits from being physically active on commercial fitness equipment, such as strengthening muscles, improving mood, burning calories, and enhancing physical fitness. Among the fitness equipment, stationary bikes are more helpful to improve cardiopulmonary function and strengthen core muscles.

Most of the commercial stationary bikes have a resistance adjustment function but cannot change the incline. Some bikes feature adjustable incline. For example, U.S. Pat. No. 10,561,877B2 (TW637770B) discloses an exercise machine that includes a frame, which includes a base portion, an upright portion, and a pivot joint. The upright portion couples to the base portion at a single pivot. The pivot joint connects the upright portion to the base portion at the single pivot. The pivot joint includes a drop-in axle and a drop-in receptacle. The drop-in axle connects to the upright portion. The drop-in receptacle connects to the base portion. The exercise machine further includes a tilt actuator that connects the base portion of the frame to the upright portion of the frame and determines an angle that the upright portion forms with respect to the base portion.

U.S. Pat. No. 9,833,661B2 discloses an exercise bike, which enables improved training control by an improved information display. The exercise bike includes a first display apparatus and a second display apparatus. The first display apparatus is directed at the exerciser for displaying one or more items of information. The second display apparatus directed at the opposite side for displaying at least one item of information. The displayed information includes training data captured on the equipment side (cadence/cycling speed, power, resistance, etc.) and also the person-related data such as, the heart rate and the maximum heart rate.

Conventional stationary bikes all include a stable base structure that is pivotally connected to an upright structure above it. The angle between the upright structure and the base structure is changed through a tilt actuator or an extension mechanism between them, thereby changing the slope of the stationary bike. While changing the slope, the resistance of the flywheel remains constant, and resistance is usually adjusted through additional operations and mechanisms. In addition, the user or trainer can only know the slope of the stationary bike through a control panel.

SUMMARY OF THE INVENTION

This summary is provided to introduce a selection of concepts in a simplified form that are further described below in the detailed description. This summary, and the foregoing background, is not intended to identify key aspects or essential aspects of the claimed subject matter. Moreover, this summary is not intended for use as an aid in determining the scope of the claimed subject matter.

In one aspect, a stationary bike is provided with a lifting mechanism, a frame, a resistance device, a reluctance mechanism, a linkage mechanism, a first cable, a linear mechanism, and a first visual indicator. The frame is connected to the lifting mechanism. The resistance device is disposed on the frame and comprises an axis and a flywheel. The reluctance mechanism is adjacent to the flywheel and pivotally connects to the frame, and the reluctance mechanism comprises a plurality of magnets. The linkage mechanism comprises a first linkage seat that is pivotally connected to the reluctance mechanism. The first cable has two ends respectively connected to the first linkage seat and the lifting mechanism. The linear mechanism being is connected between the frame and the lifting mechanism, wherein a length of the linear mechanism is adjusted to change an angle between the lifting mechanism, and at the same time the first cable drives the first linkage seat, causing the reluctance mechanism to pivot and hence to approach or move away from the flywheel thereby changing a resistance applied to the flywheel. The first visual indicator emits a light the light with a color predetermined by a first parameter comprising a slope of the stationary bike.

In some embodiments, the first visual indicator emits the light at a frequency according to a second parameter, and the selection of the second parameter comprises one of heart rate and cycling speed.

In some embodiments, the stationary bike further comprises a second visual indicator emitting or flashing a light when a third parameter reaches a predetermined value, and the selection of the third parameter includes one of exercise time and calories burned.

In some embodiments, the second visual indicator is a virtual light disposed on a screen of a display of the stationary bike.

In some embodiments, the first parameter is a slope increment ratio, which is current slope increment divided by a maximum slope increment of the stationary bike, and wherein the current slope increment is the difference between current slope and a minimum slope of the stationary bike, and the maximum slope increment is the difference between a maximum slope and the minimum slope of the stationary bike.

In some embodiments, the first visual indicator emits the light with a color predetermined by a fourth parameter, which is the first parameter plus the second parameter, and the selection of the second parameter includes one of a heart rate ratio, a cycling speed ratio, and a resistance ratio, and wherein the heart rate ratio is user's current heart rate divided by user's maximum heart rate, the cycling speed ratio is current cycling speed divided by a maximum cycling speed, and the resistance ratio is current resistance divided by a maximum resistance applied to the flywheel.

In some embodiments, the first visual indicator emits the color light with a color predetermined by a fifth parameter, which is the first parameter plus two of the second parameters, and the selection of two of the second parameters includes two of the heart rate ratio, the cycling speed ratio, and the resistance ratio.

In some embodiments, the first visual indicator comprises a plurality of first visual indicators arranged around a screen of a display of the stationary bike.

In some embodiments, the first visual indicators display the light one by one to reflect whether the change in slope is a positive or negative value.

The provided stationary bike change the slope and resistance in the meantime; therefore, visual indication of slope and additional parameters allows users and/or trainer to conveniently and quickly know the user's current training level and physiological parameters, and help them make immediate adjustments.

BRIEF DESCRIPTION OF THE DRAWINGS

Non-limiting and non-exhaustive embodiments of the disclosed technology, including the preferred embodiment, are described with reference to the following figures, wherein like reference numerals refer to like parts throughout the various views unless otherwise specified.

DETAILED DESCRIPTION OF THE PREFERRED EMBODIMENT

Embodiments are described more fully below with reference to the accompanying Figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

In the best embodiment, the present invention provides a stationary bike 1 with a slope visual indication, in which the architecture of the stationary bike 1 can be the same as that recited in U.S. patent application Ser. No. 18/771,447, filed on Jun. 18, 2024, entitled "STATIONARY BIKE CAPABLE OF ADJUSTING RESISTANCE AND SLOPE SIMULTANEOUSLY." The entire contents of the above-mentioned patent are incorporated into the description and deemed to be part of the description of this invention.

Figure 1:
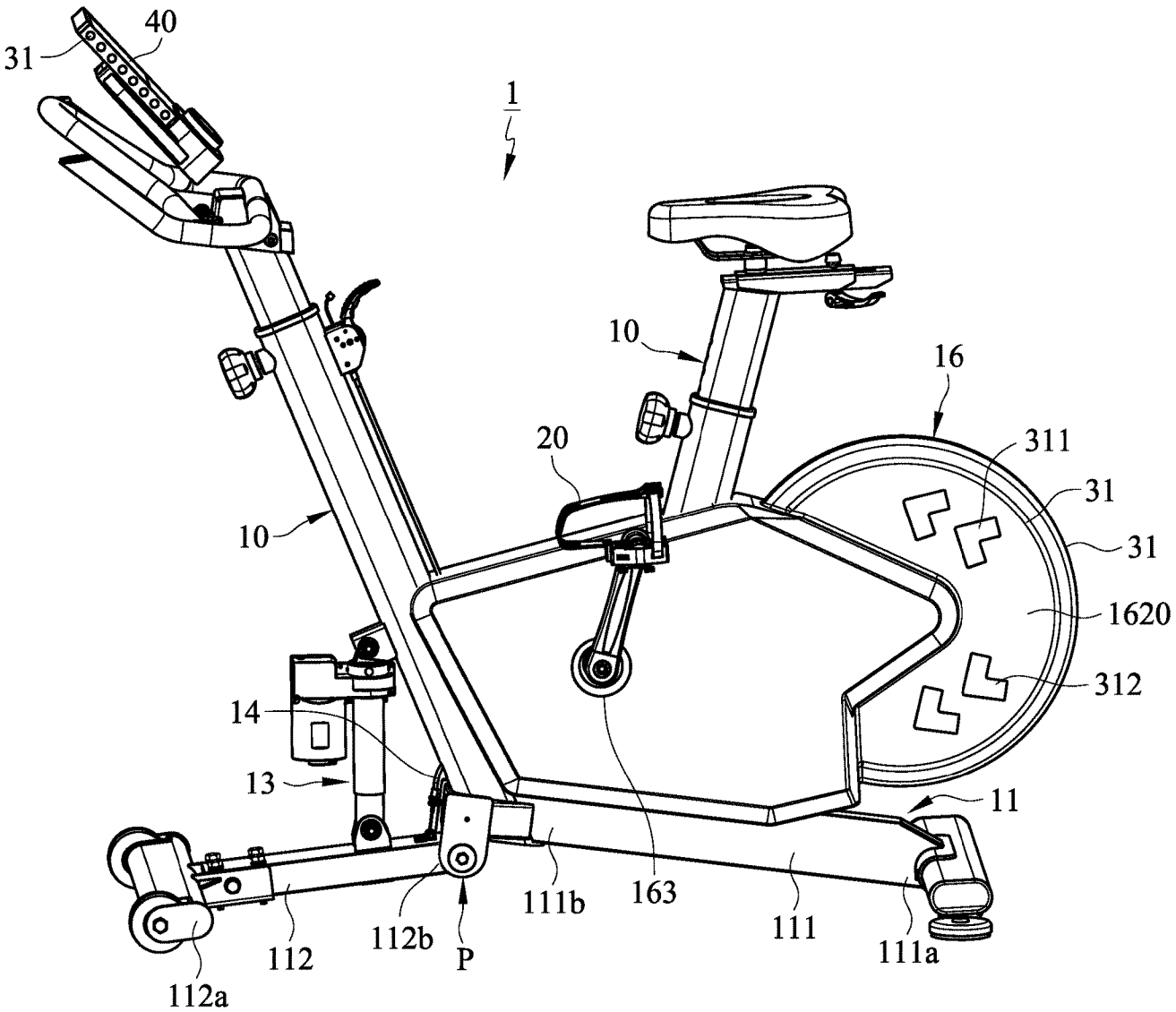
FIG. 1 is a perspective view of a stationary bike according to an embodiment of the present invention.
Figure 2:
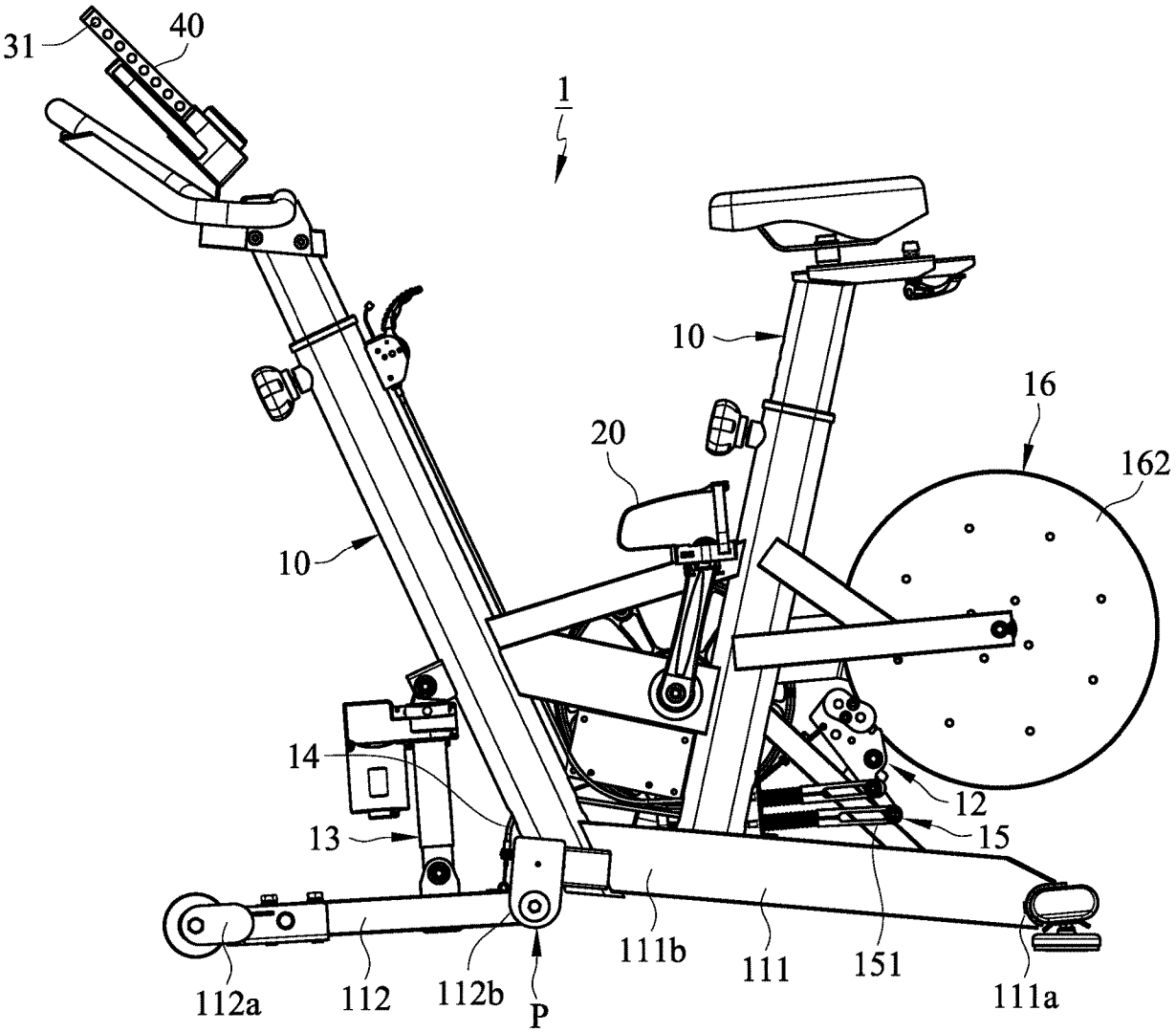
FIG. 2 is a side view of the stationary bike shown in FIG. 1 with some components removed.

FIG. 1 is a perspective view showing a stationary bike 1 in accordance with an embodiment of the present invention. FIG. 2 is a side view of the stationary bike shown in FIG. 1 with some components removed. Referring to FIGS. 1 and 2, the stationary bike 1 generally includes a frame 10, a lifting mechanism 11, a reluctance mechanism 12, a linear mechanism 13, a first cable 14, a linkage mechanism 15, and a resistance device 16. The lifting mechanism 11 includes a first lifting arm 111 and a second lifting arm 112. The first lifting arm 111 includes a first end 111*a* in contact with a ground and a second end 111*a* suspended above the ground, and the first lifting arm 111 is turnable with its first end 111*a* as a fulcrum. The second lifting arm 112 includes a first end 112*a* in contact with the ground and a second end 112*b* suspended above the ground, and the second lifting arm 112 is turnable with its first end 112*a* as a fulcrum. The second end 111*b* of the first lifting arm 111 and the second end 112*b* of the second lifting arm 112 are pivotally connected at the pivot P. The frame 10 is connected to the first lifting arm 111. The resistance device 16 is disposed on the frame 10 and comprises an axis 163 and a flywheel 162, which also referred to as "inertia wheel." The reluctance mechanism 12 is adjacent to the flywheel 162 and pivotally connected to the frame 10. The reluctance mechanism 12 includes a plurality of magnets. The linkage mechanism 15 includes a first linkage seat 151 that is pivotally connected to the reluctance mechanism 12. The first cable 14 has two ends respectively connected to the first linkage seat 151 and the second lifting arm 112 (or the first lifting arm 111 in another embodiment). The linear mechanism 13 is connected between the frame and the second lifting arm 112, wherein a length of the linear mechanism 13 is adjusted to change an angle between the first lifting arm 111 and the ground and an angle between the second lifting arm 112 and the ground, and at the same time the first cable 14 drives the first linkage seat 151, causing the reluctance mechanism 12 to pivot and hence to approach or move away from the flywheel 162 thereby changing a resistance applied to the flywheel 162.

Figure 3:
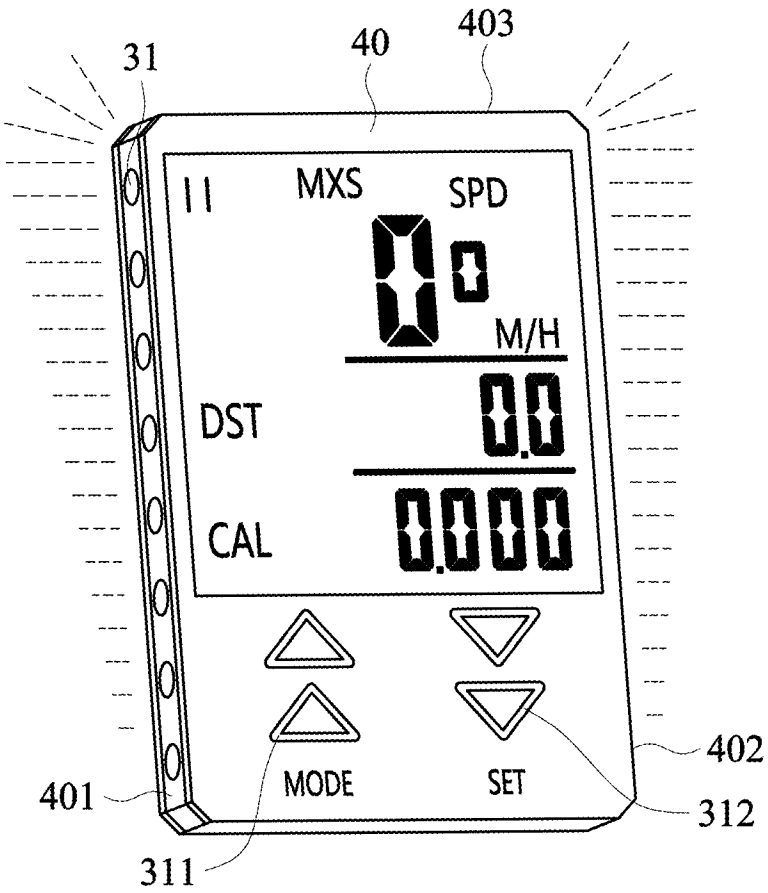
FIG. 3 shows a perspective view of first visual indicators according to an embodiment of the present invention.

Referring to FIGS. 1-3, the stationary bike 1 further includes a plurality of first visual indicators 31. In the preferred embodiment, the first visual indicators 31 are arranged around a display 40 (e.g. a stopwatch) in front of the stationary bike 1. For example, the first visual indicators 31 are arranged at the left side 401 and the right side 402 of the display 40. In the best embodiment, the first visual indicators 31 are arranged at the left side 401, the right side 402, and the upper side 403 of the display 40. This arrangement is more suitable for an instructor or trainer to observe multiple students practicing on their respective stationary bikes 1 from the front of the stationary bike 1 at the same time. The first visual indicators 31 may be integrated into a strip. Referring to FIGS. 1-3, in some embodiments, the first visual indicators 31 may further include virtual indicators, such as an uphill indicator 311 and a downhill indicator 312 provided on the screen of the display 40. In some embodiments, the flywheel 162 is covered with a housing 1620, on which some of the first visual indicators 31, as well as an uphill indicator 311 and a downhill indicator 312 are additionally disposed.

Referring to FIGS. 1-3, when the linear mechanism 13 changes its length, the slope of the stationary bike 1 changes at the same time and the first visual indicators 31 display a different color. In the embodiment, because the slope and resistance of the stationary bike 1 change in the meantime, the slope can also be used to indicate the user's training resistance level.

According to some embodiments of the present invention, a slope range of the stationary bike 1, e.g., −5° (downhill) to 12° (uphill), a total of 17° change in slope, is divided into multiple slope intervals (or slope increments, defined as the difference between the current slope and the minimum slope), and the first visual indicators 31 emit a corresponding color light according to the slope interval (or slope increment) to which the current slope belongs, as exemplary illustrated in Table 1. For example, if the current slope is 3, the first visual indicator 31 emits yellow light. In a preferred embodiment, when the user adjusts the slope of the stationary bike 1, the first visual indicators 31 arranged around the display 40 will emit (display) one by one to reflect the change in gradient as climbing or descending. For example, as shown in FIG. 3, when the user adjusts the slope and the change of the slope (current slope minus the previous slope) is a positive value, the first visual indicators 31 will emit one by one from the bottom to the top on both sides of the display 40 and their brightness can be different one another. Similarly, when the user adjusts the slope and the change of the slope is a negative value, the first visual indicators 31 will emit one by one from the top to the bottom on both sides of the display 40 and their brightness can be different from each other. In other embodiments, when the user adjusts the slope and the change in slope is a positive value, the uphill indicator 311 will display and/or flash; when the change in slope is a negative value, the downhill indicator 312 will display and/or flash.

TABLE 1

| | | | | | | | |
|---|---|---|---|---|---|---|---|
| slope interval | −5°~−2.5° | −2.4°~0° | 0.1°~2.5° | 2.6°~5° | 5.1°~7.5° | 7.6°~9.0° | 9.1°~12° |
| slope increment | 0°~2.5° | 2.6°~5° | 5.1°~7.5° | 7.6°~10° | 10.1°~12.5° | 12.6°~14.0° | 14.1°~17° |
| color displayed by the first indicators 31 | blue | cyan | green | yellow | orange | pink | crimson |

In some embodiments, in addition to display according to a first parameter-slope (or slope increment), one or more of the first visual indicators 31 further flash at a frequency (FPM, the number of times the first visual indicators 31 blink per minute) according to a second parameter. The selection of the second parameter includes one of the user's current heart rate and the user's cycling speed (rpm, the speed of the pedal 20 around the axis 163). Sensors are provided on the user's body and the stationary bike 1 to respectively measure the user's heart rate and cycling speed, and the measured data are continuously transmitted to a control system of the stationary bike 1.

According to one embodiment of the present invention, a range of the user's heart rate is divided into multiple heart rate intervals. One or more first visual indicators 31, such as the first visual indicators 31 installed around the display 40, display or emit a corresponding color light according to the current slope of the stationary bike 1, and the first visual indicators 31 blink with a frequency (FPM, the number of times the first visual indicators 31 blink per minute) according to the heart rate interval to which the user's heart rate belongs, as exemplary illustrated in Table 2.

TABLE 2

| | | | | | | | |
|---|---|---|---|---|---|---|---|
| heart rate interval (bpm) | 80 below | 81-100 | 101-120 | 121-150 | 151-180 | 181-200 | 201 and above |
| flash frequency of the first indicators (FPM) | 60 | 75 | 86 | 100 | 120 | 150 | 200 |

For example, as illustrated in Tables 1 and 2, if the current slope of the stationary bike 1 is 3 and the user's current heart rate is 110 bpm, the first visual indicator 31 installed around the display 40 will emit a yellow light as well as flash 86 times per minute that allow the user and/or instructor to intuitively know the current slope of the stationary bike 1 and the user's heart rate.

According to some embodiments of the present invention, a range of the user's cycling speed (rpm) is divided into multiple cycling speed intervals. The first visual indicators 31 display or emit a corresponding color light according to the current slope of the stationary bike 1, and the first visual indicators 31 are displayed with a frequency (FPM) according to the cycling speed interval to which the user's cycling speed belongs, as exemplary illustrated in Table 3.

TABLE 3

| | | | | | | | |
|---|---|---|---|---|---|---|---|
| cycling speed interval (rpm) | 80 below | 81-90 | 91-100 | 101-110 | 111-120 | 121-130 | 131and above |
| flash frequency of the first indicators (FPM) | 60 | 75 | 86 | 100 | 120 | 150 | 200 |

For example, as illustrated in Tables 1 and 3, if the current slope of the stationary bike 1 is 3 and the user's current cycling speed is 95 rpm, the first visual indicator 31 installed around the display 40 will emit a yellow light as well as flash 86 times per second that allow the user and/or trainer to intuitively know the current slope of the stationary bike 1 and the user's current cycling speed.

Figure 4:
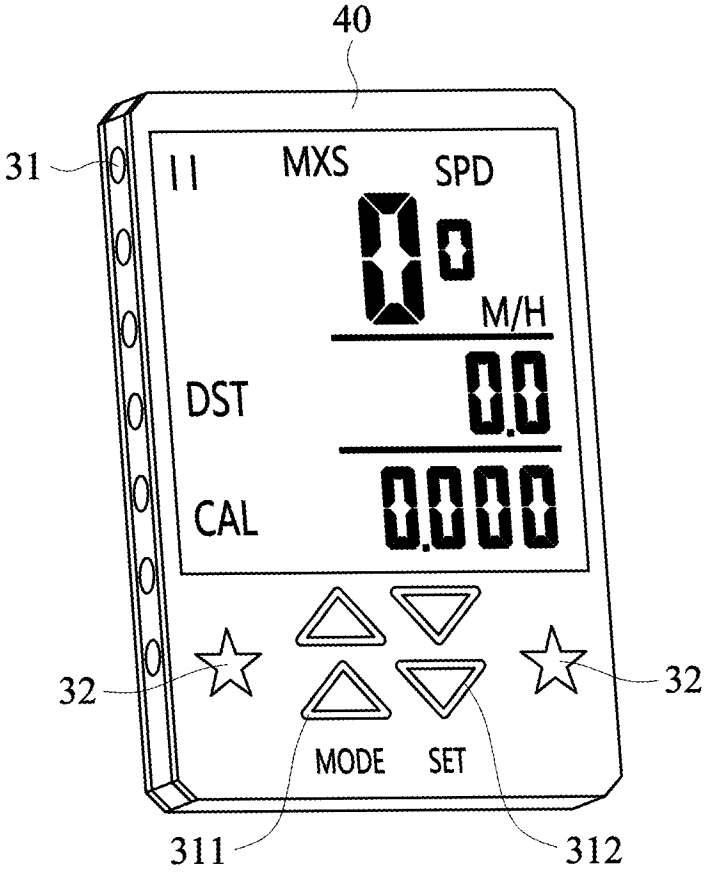
FIG. 4 shows a perspective view of first and second visual indicators according to one embodiment of the present invention.

As shown in FIG. 4, in some embodiments, the stationary bike 1 further includes one or more second visual indicators 32. When a third parameter reaches a predetermined value, the second visual indicators 32 will emit and/or flash a light. The selection of the third parameter includes the user's exercise time or calories burned. When the user's exercise time reaches a predetermined time, e.g., half an hour, or the calories burned reaches a predetermined calories, e.g., 200 calories, the second visual indicators 32 will emit and/or flash a light to remind the user taking a rest. As shown in FIG. 4, the second visual indicators 32 may be virtual lights on the screen of the display 40.

In some embodiments, the first parameter is a slope increment ratio, which is defined as the slope increment/maximum slope increment, where the slope increment is defined as the difference between the current slope and the minimum slope, and the maximum slope increment is defined as the difference between the maximum slope and the minimum slope. For example, a slope range of the stationary bike 1 is from −5 degrees to 7 degrees, a total increment of 12 degrees, and some exemplary slope increment ratios are listed in Table 4. The range of slope increment ratio is divided into multiple slope increment ratio intervals, and the first visual indicator 31 emits a corresponding color according to the slope increment ratio interval to which the current increment belongs, as illustrated in Table 5. For example, when the current slope increment ratio is less than or equal to 0.14, the first visual indicator 31 will emit a blue light. This design allows user and/or trainer to intuitively know the current training intensity.

TABLE 4

| slope | −5°(min) | −3° | −1° | 1° | 3° | 5° | 7°(max) |
|---|---|---|---|---|---|---|---|
| slope increment | 0° | 2° | 4° | 6° | 8° | 10° | 12° |
| slope increment ratio | 0.00 | 0.17 | 0.33 | 0.50 | 0.67 | 0.83 | 1.00 |

TABLE 5

| slope | −5°~−3.3° | −3.29°~−1.59° | −1.58°~0.12° | 0.13°~1.83° | 1.84°~3.54° | 3.55°~5.25° | 5.26°~7.00° |
|---|---|---|---|---|---|---|---|
| slope increment | 0°~1.7° | 1.71°~3.41° | 3.42°~5.12° | 5.13°~6.83° | 6.84°~8.54° | 8.55°~10.25° | 10.26°~12.00° |
| slope increment ratio interval | 0~0.142 | 0.143~0.284 | 0.285~0.427 | 0.428~0.569 | 0.570~0.712 | 0.713~0.854 | 0.855~1.00 |
| color displayed by the first indicators 31 | blue | cyan | green | yellow | orange | pink | crimson |

In some embodiments, a fourth parameter is the first parameter plus a second parameter, wherein the first parameter is the slope increment ratio, and the selection of the second parameter includes one of the user's heart rate ratio, cycling speed ratio, and resistance ratio of the flywheel, and the first visual indicators 31 will emit a corresponding color according to a fourth parameter interval to which the fourth parameter belongs.

According to an embodiment of the present invention, the second parameter is the heart rate ratio, which is defined as the current heart rate divided by maximum heart rate, and its value is between 0 and 1. For example, in an example illustrated in Table 6, the range of user's heart rate is 80 to 210 bpm. If the current heart rate is 150 bpm, the heart rate ratio is 150/210=0.71. In a preferred embodiment, each user can input the minimum heart rate and the maximum heart rate through a control panel to define a heart rate range suits him or her.

TABLE 6

| current heart rate (bpm) | 80 | 105 | 125 | 145 | 165 | 195 | 210 |
|---|---|---|---|---|---|---|---|
| heart rate ratio | 0.38 | 0.50 | 0.60 | 0.69 | 0.79 | 0.93 | 1.00 |

According to one embodiment of the present invention, a resistance range of the stationary bike 1 is from level 0 to level 13, and the second parameter is the resistance ratio, which is defined as the current resistance (level) divided by the maximum resistance (level), and its value is between 0 and 1, as illustrated in Table 7. For example, if the resistance is level 4, then the resistance ratio is 4/13=0.31. In a preferred embodiment, the stationary bike 1 includes a knob (not shown) to adjust an initial distance between the reluctance mechanism 12 and the flywheel 162 such that each user can adjust the resistance range that suits him or her. For example, a smaller initial distance between the reluctance mechanism 12 and the flywheel 162 will result in a larger initial resistance of the stationary bike 1.

TABLE 7

| resistance (level) | 0 | 2 | 4 | 6 | 8 | 10 | 13 |
|---|---|---|---|---|---|---|---|
| resistance ratio | 0.00 | 0.15 | 0.31 | 0.46 | 0.62 | 0.77 | 1.00 |

According to an example the present invention, the user's minimum cycling speed is 0 rpm and the maximum is 140 rpm. And the cycling speed ratio is defined as the current cycling speed (rpm) divided by the maximum cycling speed (rpm), and its value is between 0 and 1, as illustrated in Table 8.

TABLE 8

| current cycling speed (rpm) | 0 | 25 | 50 | 70 | 95 | 120 | 140 |
|---|---|---|---|---|---|---|---|
| cycling speed ratio | 0.00 | 0.18 | 0.36 | 0.50 | 0.68 | 0.86 | 1.00 |

According to an example of the present invention, the fourth parameter is "slope increment ratio" plus "heart rate ratio," and its value is between 0 and 2, as illustrated in Table 9.

TABLE 9

| | slope increment ratio | | | | | | |
|---|---|---|---|---|---|---|---|
| hear rate ratio | 0.00 | 0.17 | 0.33 | 0.50 | 0.67 | 0.83 | 1.00 |
| 0.00 | 0.00 | 0.17 | 0.33 | 0.50 | 0.67 | 0.83 | 1.00 |
| 0.15 | 0.15 | 0.32 | 0.49 | 0.65 | 0.82 | 0.99 | 1.15 |
| 0.31 | 0.31 | 0.47 | 0.64 | 0.81 | 0.97 | 1.14 | 1.31 |
| 0.50 | 0.50 | 0.67 | 0.83 | 1.00 | 1.17 | 1.33 | 1.50 |
| 0.62 | 0.62 | 0.78 | 0.95 | 1.12 | 1.28 | 1.45 | 1.62 |
| 0.77 | 0.77 | 0.94 | 1.10 | 1.27 | 1.44 | 1.60 | 1.77 |
| 1.00 | 1.00 | 1.17 | 1.33 | 1.50 | 1.67 | 1.83 | 2.00 |

In one embodiment, a range of the fourth parameter (0-2) is divided into a plurality of fourth parameter intervals, and the first visual indicator 31 will emit a corresponding color light according to the fourth parameter interval to which the fourth parameter belongs, as illustrated in Table 10. For example, if the fourth parameter is 1.32, the first visual indicator 31 emits an orange light.

TABLE 10

| fourth parameter interval | 0~0.28 | 0.29~0.57 | 0.58~0.86 | 0.87~1.15 | 1.16~1.44 | 1.45~1.73 | 1.74~2 |
|---|---|---|---|---|---|---|---|
| color displayed by the first indicators 31 | blue | cyan | green | yellow | orange | pink | crimson |

In an embodiment, the fourth parameter is "slope increment ratio"+"resistance ratio." In another embodiment, the fourth parameter is "slope increment ratio"+"cycling speed ratio."

In some embodiments, a fifth parameter is the first parameter plus two different second parameters, where the first parameter is the slope increment ratio, and the selection of the second parameter includes the heart rate ratio, the cycling speed ratio, and the resistance ratio. And the first visual indicators 31 will emit a corresponding color light according to a fifth parameter interval to which the fifth parameter belongs.

In an example, the fifth parameter is the slope increment ratio plus the resistance ratio and the cycling speed ratio, with a minimum value of 0 and a maximum of 3. The first visual indicators 31 will emit a predetermined color light according to the fifth parameter interval to which the fifth parameter belongs, as illustrated in Table 11. In a better example, the fifth parameter is the slope increment ratio plus the resistance ratio and the heart rate ratio, with a minimum value of 0 and a maximum value of 3.

TABLE 11

| fifth parameter interval | 0-0.42 | 0.43-0.85 | 0.86-1.28 | 1.29-1.71 | 1.72-2.14 | 2.15-2.57 | 2.58-3.00 |
|---|---|---|---|---|---|---|---|
| color displayed by the first indicators 31 | blue | cyan | green | yellow | orange | pink | crimson |

In some embodiments, through a control panel (not shown), the user can respectively input the color and/or frequency of the first indicators 31 corresponding to the individual intervals of each of the aforementioned first to fifth parameters.

The stationary bike provided by the present invention with visual indication of slope and additional parameters allows users and/or trainers to conveniently and quickly know the user's current training level and physiological parameters, and help them make immediate adjustments.

Although the above embodiment shows a stationary bike with an adjustable incline. It is understood that the principles described in this specification can be applied to any suitable exercise equipment, such as, but not limited to, elliptical trainers, steppers, rowing machines, etc.

From the foregoing, it will be appreciated that specific embodiments of the invention have been described herein for purposes of illustration, but that various modifications may be made without deviating from the scope of the invention. Accordingly, the invention is not limited except as by the appended claims.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended.

What is claimed is:

1. A stationary bike, comprising:

a lifting mechanism;

a frame being connected to the lifting mechanism;

a resistance device disposed on the frame and comprising an axis and a flywheel;

a reluctance mechanism adjacent to the flywheel and pivotally connected to the frame, the reluctance mechanism comprising a plurality of magnets;

a linkage mechanism comprising a first linkage seat that is pivotally connected to the reluctance mechanism;

a first cable having two ends respectively connected to the first linkage seat and the lifting mechanism;

a linear mechanism being connected between the frame and the lifting mechanism, wherein a length of the linear mechanism is adjusted to change an angle between the lifting mechanism and the ground, and at the same time the first cable drives the first linkage seat, causing the reluctance mechanism to pivot and hence to approach or move away from the flywheel thereby changing a resistance applied to the flywheel; and a first visual indicator emitting a light with a color determined by a first parameter comprising a slope of the stationary bike.

2. The stationary bike according to claim 1, wherein the first visual indicator emits the light at a frequency according to a second parameter, and the selection of the second parameter comprises one of heart rate and cycling speed.

3. The stationary bike according to claim 2, further comprising a second visual indicator, wherein the second visual indicator emits or flashes a light when a third parameter reaches a predetermined value, and the selection of the third parameter includes one of exercise time and calories burned.

4. The stationary bike according to claim 3, wherein the second visual indicator is a virtual light disposed on a screen of a display of the stationary bike.

5. The stationary bike according to claim 2, wherein the first parameter is a slope increment ratio, which is a slope increment divided by a maximum slope increment of the stationary bike, and wherein the slope increment is the difference between current slope and a minimum slope of the stationary bike, and the maximum slope increment is the difference between a maximum slope and the minimum slope of the stationary bike.

6. The stationary bike according to claim 5, wherein the first visual indicator emits the light with the color predetermined by a fourth parameter, which is the first parameter plus the second parameter, and the selection of the second parameter includes one of a heart rate ratio, a cycling speed ratio, and a resistance ratio, and wherein the heart rate ratio is user's current heart rate divided by user's maximum heart rate, the cycling speed ratio is current cycling speed divided by a maximum cycling speed, and the resistance ratio is current resistance divided by a maximum resistance applied to the flywheel.

7. The stationary bike according to claim 6, wherein the first visual indicator emits the light with the color predetermined by a fifth parameter, which is the first parameter plus two of the second parameters, and the selection of two of the second parameters includes two of the heart rate ratio, the cycling speed ratio, and the resistance ratio.

8. The stationary bike according to claim 1, wherein the first visual indicator comprises a plurality of first visual indicators arranged around a screen of a display of the stationary bike.

9. The stationary bike according to claim 8, wherein the plurality of first visual indicators emit the light one by one to reflect whether the change in slope is a positive or negative value.

10. The stationary bike according to claim 1, wherein the lifting mechanism comprises:

a first lifting arm comprising a first end in contact with the ground and a second end suspended above the ground, wherein the first lifting arm is turnable with its first end as a fulcrum; and a second lifting arm comprising a first end in contact with the ground and a second end suspended above the ground, wherein the second lifting arm is turnable with its first end as a fulcrum, and the second end of the first lifting arm and the second end of the second lifting arm are pivotally connected at a pivot.

* * * * *